United States Patent [19]

Tidman et al.

[11] Patent Number: 4,907,487

[45] Date of Patent: Mar. 13, 1990

[54] APPARATUS FOR AND METHOD OF ACCELERATING A PROJECTILE THROUGH A CAPILLARY PASSAGE AND PROJECTILE THEREFOR

[75] Inventors: Derek A. Tidman, Silver Spring, Md.; Yong C. Thio, Alexandria, Va.; Yeshayahu Shyke A. Goldstein, Gaithersburg, Md.

[73] Assignee: GT-Devices, Alexandria, Va.

[21] Appl. No.: 929,365

[22] Filed: Nov. 12, 1986

[51] Int. Cl.[4] ..... F41F 1/02

[52] U.S. Cl. ..... 89/8; 89/28.05; 124/3

[58] Field of Search ..... 42/84; 89/8, 28.05, 89/135; 124/3; 310/12; 318/135

[56] References Cited

U.S. PATENT DOCUMENTS

| | | | |
|---|---|---|---|
| 667,435 | 2/1901 | Friese-Greene et al. | 89/28.05 |
| 1,332,060 | 2/1920 | Pacilli | 89/28.05 |
| 2,790,354 | 4/1957 | Yoler et al. | 89/8 |
| 2,926,566 | 3/1960 | Atkins et al. | 89/28.05 |
| 3,468,217 | 9/1969 | Cooley | 89/8 |
| 4,590,842 | 5/1986 | Goldstein et al. | 89/8 |

OTHER PUBLICATIONS

Goldstein et al., "Final Report on Research and Development of A Plasma Jet Mass Accelerator as A Driver for Impact Fusion", NTIS, Order Number DE84012940, Jun. 13, 1984, pp. 1–54.

J. W. Ryan, Guns, Mortars & Rockets, 1982, pp. 58–59, 62.

*Primary Examiner*—Stephen C. Bentley

*Attorney, Agent, or Firm*—Lowe, Price, LeBlanc, Becker & Shur

[57] ABSTRACT

A high pressure plasma initially formed from a fluidizable substance in a confined region of a passage behind a projectile in the passage initially accelerates the projectile toward an open end of the passage. The plasma in the confined region is ohmically heated to a higher pressure by a discharge current flowing longitudinally through the passage and the projectile.

33 Claims, 3 Drawing Sheets

APPARATUS FOR AND METHOD OF ACCELERATING A PROJECTILE THROUGH A CAPILLARY PASSAGE AND PROJECTILE THEREFOR

TECHNICAL FIELD

The present invention relates generally to methods of and apparatus for accelerating projectiles with high pressure plasmas and more particularly to a method of and apparatus for accelerating a projectile through a capillary passage in response to a material being evaporated to form a high pressure plasma that is ohmically heated in the passage behind the projectile. In accordance with another aspect of the invention, new and improved projectiles include means for conducting current in the plasma and maintaining a substantial pressure between opposite ends thereof.

BACKGROUND ART

In the co-pending, commonly assigned, applications Ser. No. 657,888, filed Oct. 5, 1984, entitled "Cartridge Containing Plasma Source for Accelerating a Projectile" and Ser. No. 809,071, filed Dec. 11, 1985, entitled "Plasma Propulsion Apparatus and Method" there are disclosed an apparatus for and method of accelerating a projectile with a high pressure plasma produced in response to a high voltage discharge. The projectile is located in a gun barrel downstream of a high pressure source of ionized gas including a capillary passage, i.e., a passage having a length to diameter ratio of at least 10:1. The passage includes ionizable material, preferably low atomic weight elements in molecules forming the passage wall. The low atomic weight elements (e.g. hydrogen and carbon) are ablated from the wall in response to a high voltage discharge established between spaced first and second electrodes, respectively located at open and closed ends of the passage. The passage dimensions and ionized materials cause the discharge to have a relatively high resistance, such as 0.1 ohm. A gas having a high pressure, such as in excess of 100 bars, is established in the capillary passage and escapes through the open end of the passage to accelerate a projectile in a gun barrel, usually made of steel, located immediately downstream of the open end.

To maximize the projectile velocity, an electric ionizing pulse supplied to the electrodes is shaped so the pressure behind the projectile in the barrel is maintained substantially constant despite the increasing volume in the barrel behind the moving projectile. The electric pulse is shaped so the power applied to the discharge increases substantially linearly as a function of time while the projectile is being accelerated through the barrel. The pulse is terminated prior to the projectile reaching the muzzle end of the barrel, approximately at the time that the projectile has traversed approximately one-half of the barrel length.

A confined mass of evaporable, ionizable material is located between the open end of the capillary tube and the back end of the projectile. This mass of material is evaporated and then ionized by plasma in the discharge to add additional propulsive force to the projectile and to cool the plasma discharge escaping from the open end of the capillary passage. Preferably, the evaporable material between the open end of the capillary and the back end of the projectile includes low atomic weight elements, such as hydrogen and carbon.

While the prior art structures have functioned satisfactorily for many purposes, they have generally been limited to accelerating projectiles to about 5 kilometers per second because high atomic weight elements, e.g., iron, of the gun barrel are melted and evaporated by the plasma to reduce the sound speed of the projectile accelerating gas. To avoid barrel wall melting, it is necessary to maintain the temperature of gas flowing into the gun barrel to below about 3500° K. This limitation of 3500° K. translates into a projectile velocity limitation of about 5 kilometers per second for hydrogen-rich flows.

It is, accordingly, an object of the present invention to provide a new and improved apparatus for and method of accelerating a projectile through the use of electric discharge plasmas.

Another object of the invention is to provide a new and improved apparatus for and method of enabling high pressure gases to be built up behind a projectile in response to a plasma discharge that initiates the plasma.

Another object of the invention is to provide a new and improved apparatus for and method of accelerating projectiles to speeds in excess of 10 kilometers per second.

An additional object of the present invention is to provide a new and improved apparatus for and method of accelerating projectiles wherein the projectile velocity is not limited by melt characteristics of an elongated barrel downstream of a high pressure, high temperature plasma source.

DISCLOSURE OF INVENTION

In accordance with one aspect of the present invention, the prior art is modified so the projectile initially resides in the capillary passage and a discharge current is established between spaced regions along the passage through the projectile. In particular, an apparatus for accelerating a projectile comprises a structure having a dielectric wall forming a capillary passage. Low atomic weight ionizable elements (e.g. hydrogen and carbon) in the passage, preferably in the form of ablatable material on the tube wall, are ionized to form a plasma in response to a discharge formed between first and second electrodes at spaced regions along the passage length. One end of the tube is closed and the other end of the tube is open so that a projectile in the passage can be projected through it. The discharge established along the length of the passage between the electrodes includes electrons that are conducted through the projectile. The discharge ionizes and ablates material from the wall in front and in back of the projectile to form a high pressure gas in a confined region behind the projectile. The pressure in the region behind the projectile is much higher than the pressure in the passage in front of the projectile to accelerate the projectile at a high speed along the passage and through the passage open end; the projectile escape velocity from the passage open end, i.e., the projectile muzzle velocity, can exceed 10 kilometers per second. Only low atomic weight elements, e.g. hydrogen and carbon, are in the high pressure plasma accelerating the projectile so that high atomic weight elements are not injected into the plasma. Thereby, the sound speed of the accelerating gas is not reduced by foreign materials and the stated very high projectile velocity is attained.

Preferably, a confined mass of low atomic weight evaporable ionizable substance is in the tube passage behind the projectile. The substance is evaporated to establish a high pressure behind the projectile to initially accelerate the projectile toward the open end. The projectile is thereafter accelerated by the high pressure gas in the confined region behind the projectile resulting from the plasma formed by the ablated material. The substance is ionized by a discharge, which may or may not be the same discharge as the discharge which establishes the plasma discharge between the electrodes.

The ionized substance and the ablated, ionized material behind the projectile form a high resistance, high pressure plasma gas behind the projectile. Ionized material in the passage in front of the projectile is a low resistance plasma having relatively low pressure. Thereby, the gases behind the projectile are subjected to greater ohmic heating than gases in front of the projectile to assist in providing a greater pressure behind the projectile than in front of the projectile. The ablated gaseous material in the passage in front of the projectile is very hot and therefore flows rapidly out of the muzzle without being pushed by the projectile, so that it does not impede the projectile movement through the passage. The confined substance is such that the discharge in the passage behind the projectile is relatively cool to assist in maintaining a high electrical resistivity and high pressure in the gases behind the projectile.

Preferably, the substance is in fluidizable form, so it has a large surface area when subjected to the plasma. This enables the plasma to have an initial relatively low temperature and therefore relatively high electrical resistance that promotes ohmic heating of the plasma. There is a controlled release of plasma from the fluidizable substance. If the substance is a fluidizable particulate, the plasma release rate is a function of the size of the particles in the substance and the amplitude of the discharge current in the substance. The discharge current amplitude is shaped in a predetermined manner to control the plasma release for the size range of the particles. Small grains, e.g., particles having a diameter of about 20 microns, evaporate considerably faster and generate plasma at a faster rate than large grains, e.g., of 100 micron diameter.

In the preferred embodiments, the projectile includes a dielectric body and has a diameter approximately equal to but slightly smaller than the diameter of the capillary passage. The projectile is constructed so that a high pressure differential can be established between the front and back thereof while the projectile is being accelerated through the passage. The projectile includes means extending completely between the front and back ends of the projectile for conducting electric current in the discharge between the first and second spaced electrodes.

In one embodiment, the current conducting means includes a narrow passage running the length of a central region in the projectile, between the front and back of the projectile. In this embodiment, the projectile length and diameter are approximately equal and the passage in the projectile has a diameter of between approximately $\frac{1}{4}$ and 1/5 of the projectile diameter. If the projectile diameter is outside of this range the required pressure differential between the front and back of the projectile is not maintained or an inadequate current flows between the spaced electrodes.

In other embodiments, the projectile is solid and the current conducting means includes a high electric conductivity metal member, e.g. tungsten, extending between the front and back of the projectile, either through the center or along the periphery of the projectile. All exposed surfaces of the metal member are coated with a further electrical conductor having a low atomic weight, such as carbon. The coating is sufficiently thick to prevent ablation of the high atomic weight, underlying metal member by the discharge, whereby high atomic weight material from the metal element does not flow in the passage to lower the sound speed of the gases in the capillary and impede the projectile movement. Instead, the low atomic weight coating is ablated into the passage and does not adversely affect the projectile speed.

It is accordingly a further object of the invention to provide a new and improved projectile particularly adapted to conduct a discharge current between spaced electrodes along the length of a passage through which the projectile is accelerated, while maintaining a substantial pressure differential between opposite ends of the projectile.

Another object of the invention is to provide a new and improved light weight projectile with an opening dimensioned to conduct adequate current in a plasma discharge between spaced electrodes along the length of a passage through which the projectile is accelerated while maintaining, between opposite ends of the projectile, a sufficiently high pressure to enable the projectile to reach a velocity of several kilometers per second.

Still a further object of the invention is to provide a new and improved solid projectile with a high electric conductivity member for conducting current in a plasma discharge between spaced electrodes along the length of a passage through which the projectile is accelerated wherein the member is arranged so that it does not ablate into the passage, high atomic weight material, which would reduce the sound speed of gases in the passage and slow the projectile.

According to a further aspect of the invention, a new and improved method of accelerating a projectile involves locating the projectile initially in a capillary tube having a dielectric wall with ionizable material in the capillary passage. A discharge is established along the length of the passage between spaced points along the length of the passage and through the projectile. The discharge causes the material to be ionized in front of and behind the projectile to form a high pressure region behind the projectile to accelerate the projectile along the tube passage and through the open end of the tube. A high resistance plasma discharge is provided behind the projectile in the passage, as are the high and low temperature gases in front of and behind the projectile, as discussed supra. The accelerated projectile is launched from the open end of the capillary passage, where one of the electrodes is located.

The prior art problems of barrel overheating are thus completely avoided. In addition, energy is efficiently transferred directly from the plasma to the projectile while the projectile is traversing the capillary passage, in contrast to the prior art structures wherein hot gases escape through an outwardly flared nozzle into a barrel bore where the projectile is initially located. Because the gun barrel bore, i.e., capillary passage, is not a limiting factor in the present invention and because of the increased efficiency attained by establishing the high pressure, high resistance, low temperature plasma gas behind the projectile in the passage, projectile velocities of above 10 kilometers per second are achieved.

To maximize projectile velocity, it is preferable for a shaped pulse source to be used as a power supply for the discharge. As in the prior art, it is preferable for the power in the pulse to increase linearly, as a function of time, as the projectile is being accelerated through the passage, with the pulse being terminated when the projectile has traversed approximately one half of the passage.

It is, accordingly, a further object of the invention to provide a new and improved apparatus for and method of accelerating a projectile through a capillary passage, wherein material in the passage is arranged so that the electric resistance and pressure of the material behind the projectile are appreciably greater than the resistance and pressure of the material ahead of the projectile in the passage.

Still an additional object of the invention is to provide a new and improved apparatus for and method of accelerating a projectile wherein the temperature of confined plasma behind the projectile is considerably less than the temperature of plasma in a capillary passage ahead of the projectile.

The above and still further objects, features and advantages of the present invention will become apparent upon consideration of the following detailed description of several specific embodiments thereof, especially when taken in conjunction with the accompanying drawings.

Figure 1:
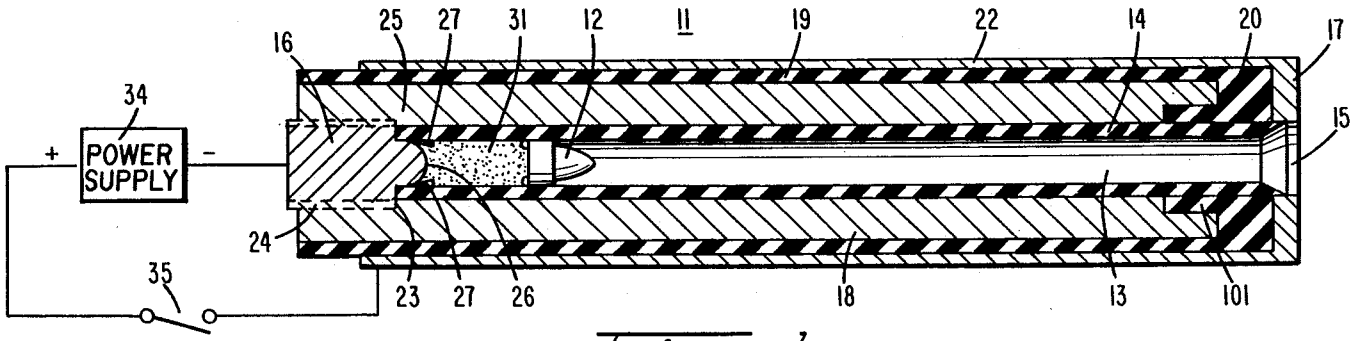
FIG. 1 is a cross-sectional view of a gun in accordance with a first embodiment of the invention.
Figure 2:
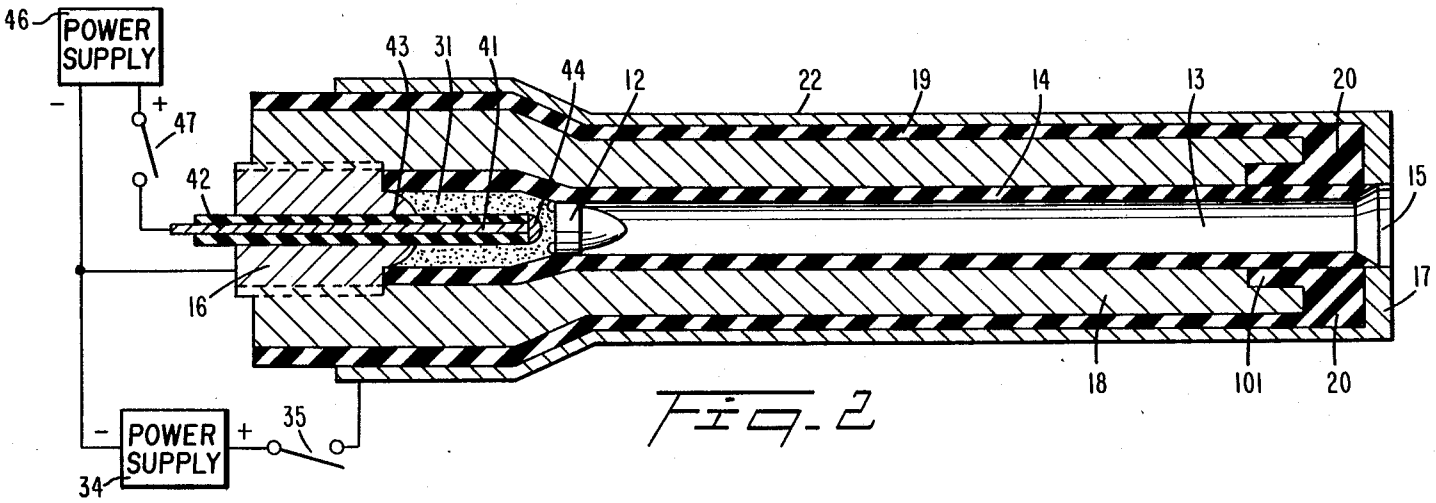
FIG. 2 is a cross-sectional view of a gun in accordance with a second embodiment of the invention.
Figure 4:
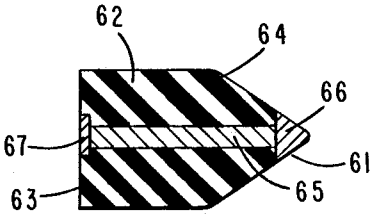
Figure 5:
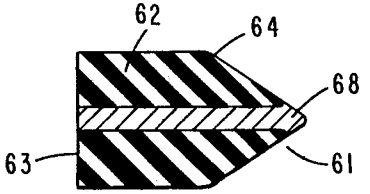
Figure 6:
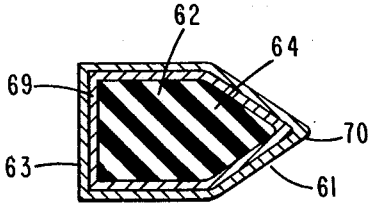
Figure 7:
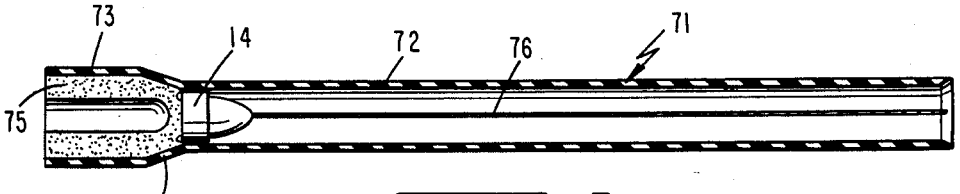
Figure 8:
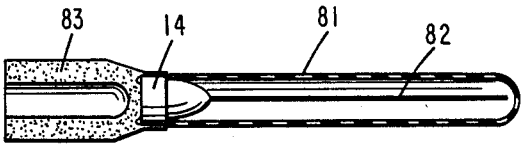
Figure 9:
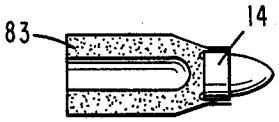
Figure 10:
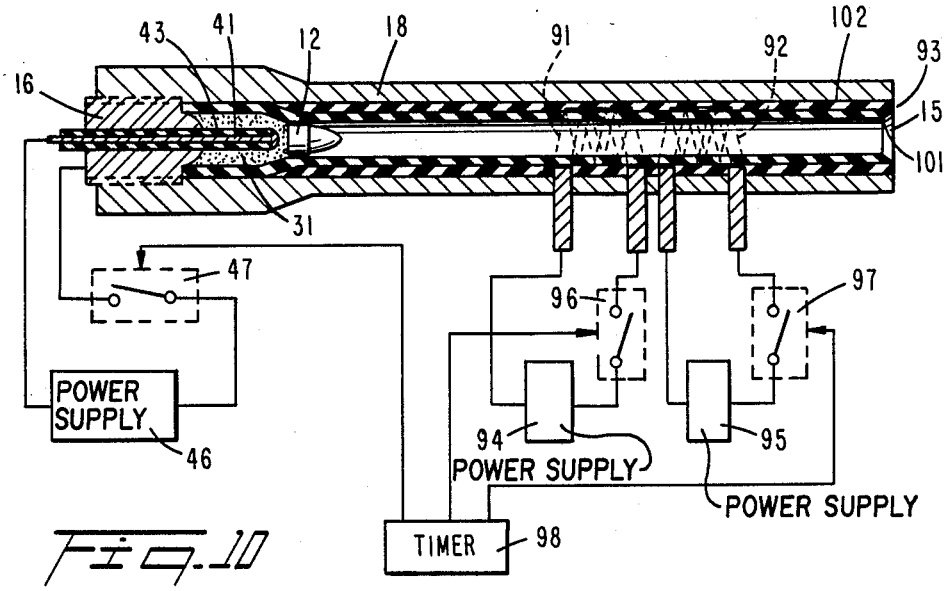

FIGS. *3a* and *3b* include several waveforms helpful in describing the embodiment of FIG. 2;

FIGS. 4–6 are cross-sectional views of three different embodiments of projectiles in accordance with the invention and which are particularly adapted to be inserted into the guns of FIG. 1 and FIG. 2;

FIGS. 7–9 are schematic views of three different embodiments of cartridges particularly adapted to carry the projectiles of FIGS. 4–6, with structure or a method to prevent gun barrel ablation; and FIG. 10 is a schematic cross-section of a further embodiment of the invention.

BEST MODE FOR CARRYING OUT THE INVENTION

Reference is now made to FIG. 1 of the drawing wherein there is illustrated a cross-sectional view of electrothermal gun 11 capable of accelerating projectile 12 to velocities of approximately 10 kilometers per second or greater. Projectile 12 is located in capillary passage 13, i.e., a passage having a length to diameter ratio of at least 10:1. The wall of capillary passage 13 is defined by the inner diameter of dielectric tube 14, fabricated of materials having relatively low atomic weight, such as hydrogen and carbon, and of materials that evaporate at a time subsequent to the projectile being accelerated out of gun muzzle or open end 15 for passage 13. A typical material on the inner wall of tube 14 is polyethylene that is ablated by an electric discharge to form a plasma. The outer wall of tube 14 and the tube interior include a mixture of polyethylene and gun powder or other material that completely evaporates and flows as a gas out of muzzle 15 after each projectile firing. The interior wall of tube 14 only includes the low atomic weight materials which have high sound speed and do not seriously slow down the projectile when ablated from the wall in front of the projectile. Prior to each projectile being launched a new tube 14 is inserted into passage 13. At open end 15 tube 14 is flared outwardly; a second end of passage is closed, i.e., plugged, by cathode electrode 16. Anode electrode 17 encircles open end 15 and abuts against the end of tube 14 opposite from the end of the tube which abuts against cathode 16.

To enable tube 14 to withstand the high pressures which are generated in passage 13, the tube is surrounded by and fits closely against the interior cylindrical wall of steel gun tube 18 so that tube 14 is considered as a liner for tube 18. The interior wall or bore of tube 18 is roughened to provide better adherence between tubes 14 and 18 while projectile 12 is moving through passage 13. The exterior cylindrical wall of gun tube 18 and the end portion of the gun tube abutting against anode 17 are covered by a high strength dielectric body formed by sleeve 19 and end cap 20. Sleeve 19 has an inner wall that abuts against and is secured to the outer cylindrical wall of gun tube 18. Gun tube 18 includes a hollow ring portion along the inner wall thereof, that receives annular flange 101 of end cap 20 which extends around and is bonded to the end and outer wall of the gun tube. Electrical and mechanical connections are established to anode 17 by metal sleeve 22 that is integral with the anode. Sleeve 22 has an inner cylindrical wall abutting against and secured to the outer cylindrical wall of insulating sleeve 19.

Cathode 16 is a high strength (preferably tungsten alloy) cylindrical block including shoulder 23 which abuts against a planar end face of tube 14 which is opposite from the outwardly flared end of the tube. Cathode 16 includes cylindrical outer wall 24 that extends beyond the outer cylindrical wall of tube 14 and is threadedly secured to a recessed cylindrical wall in steel gun tube 18; shoulder 23 of electrode 16 abuts against and is bonded to a planar face 25 of gun tube 18 which is coplanar with the end face of tube 14 that abuts against cathode shoulder 23. It has been found that this particular construction is highly advantageous because it prevents extrusion of tube 14 into the back end of the gun in response to the very high pressure that is established in passage 13 between the back of projectile 12 and cathode 16. In response to the high pressure in the region between projectile 13 and electrode 16 the end of tube 14 abutting against shoulder 23 is driven against the shoulder and the tube expands radially against the interior wall of gun tube 18 to maintain the mechanical integrity of tube 14.

Extending from shoulder 23 of electrode 16 into passage 13 is smooth rounded, preferably hemispherical extension 26, having the same diameter as the inner diameter of tube 14. High strength, dielectric wedges 27, preferably formed of Lexan, extend generally longitudinally of passage 13 and are initially positioned in a gap between hemispherical extension 26 of electrode 16 and the interior wall of tube 14. In response to high pressure gases established between the back end of projectile 12 and cathode 16, wedges 27 are driven further into the gap, toward the back of the gun, i.e., axially in a directional away from open end 15, to assist in forming a high pressure seal between the back of the projectile and cathode 16, to prevent escape of gases to the gun exterior from the portion of passage 13 between the projectile and cathode. Wedges 27 are consumed by the plasma and converted into gases that flow out of muzzle 15 with the combustion products of tube 14.

Preferably, but not necessarily, a confined mass of ionizable material 31 is initially located in passage 13 between electrode 16 and the back end of projectile 12. Confined material or substance 31 is preferably located in an envelope having thin, rigid sides (not shown in FIG. 1); the envelope is fabricated of evaporable material, such as polyethylene. The envelope evaporation rate is such that the material forming the envelope is vaporized after projectile 12 has been blown out of muzzle 15 and the vapor from the envelope is thereafter ejected from the muzzle with high pressure plasma in passage or barrel 13. Confined mass 31 is a fluidizable material (i.e., a fluid or particulate solid that behaves as a fluid) which can be any suitable vaporizable and ionizable, dielectric, such as water, lithium hydride powder, polyethylene spheres or powder, or methanol, that is converted into a plasma in response to an electric discharge. If confined material 31 is an electrolyte, sufficient current flows through the electrolyte under atmospheric conditions to establish a discharge in the electrolyte to initiate a plasma in the region between projectile 12 and cathode 16.

Because mass 31 is a fluidizable material having a large surface area, it forms a relatively low temperature plasma when subjected to a discharge current. The low temperature of the plasma causes the plasma to have a high electrical resistance which promotes ohmic heating. The rate of ohmic heating, which controls the rate at which pressure in the plasma increases, is a function of the surface area of the fluidizable material heated by the discharge and the amplitude of a discharge current that is programmed to vary in a predetermined manner. For particulates having small size, e.g. powders with diameters of about 20 microns, there is a faster evaporation rate than for larger size particulates.

A discharge is established between cathode 16 and anode 17 in passage 13 through projectile 12 by connecting opposite electrodes of high voltage pulsed power supply 34 across cathode 16 and anode 17 via switch 35. Preferably, power supply 34 is a high voltage DC source configured as a pulse forming network, constructed to produce a shaped waveform such that the square of the current supplied by the power supply through switch 35 increases linearly as a function of time while the projectile is accelerated through between one-third and one-half of the length of passage 13. Such an arrangement enables the pressure in passage 13, behind projectile 12, to remain relatively constant while the projectile is being accelerated through the length of the passage.

In operation, a high temperature (several electron volts) anode plasma arc is established between anode 17 and the forward end of projectile 12 in barrel 13, downstream of the projectile. Simultaneously, a relatively low temperature cathode plasma arc is established between the back end of projectile 12 and cathode electrode 16. Electric current in the anode arc flows to and through projectile 12 and continues through the cathode arc to cathode 16. After an initial breakdown phase during which the plasma discharge is established, the anode arc pressure is relatively low compared to the pressure of the cathode arc behind projectile 12. Both the anode and cathode arcs ablate low atomic weight elements, such as hydrogen and carbon, from the inner wall of tube 14. The material ablated from the inner wall of tube 14 in front of projectile 12 becomes a very high temperature gas (e.g. several electron volts) having a high sound speed so it flows out of opening or muzzle 15 of gun 11 without being pushed by the projectile, to assist in maintaining the pressure in passage 13 in front of projectile 12 low relative to the pressure behind the projectile.

The cathode arc behind projectile 12 initially has a relatively low temperature, for example 1.5 electron volts, so it is cooler than the plasma arc. The cathode arc is initially cooler than the anode arc because the ionizable material 31 in passage 13 between the rear of projectile 12 and cathode 16 has a larger mass than the material in front of projectile 12, although both materials have approximately the same coefficient of thermal conductivity. In addition, the greater amount of energy required to evaporate the low atomic weight material 31 behind projectile 12 causes the cathode arc to initially have a lower temperature than the anode arc.

The type of the ionizable material 31, specified supra, controls the atomic species in the plasma of the cathode arc behind the projectile. Ionizable material 31 causes the cathode arc plasma to have a high electric resistance compared to that of the anode arc. The nature of ionizable material 31 causes electron-neutral atom scattering at the relatively low temperatures of the cathode plasma arc. Because of the relatively high resistance of the cathode arc and the equal current amplitude in the anode and cathode arcs there is greater ohmic heating in the plasma behind projectile 12, which in turn causes the gases in the portion of passage 13 behind projectile 12 to have a high pressure compared to the pressure of the passage in front of projectile 12. The high pressure gases are trapped in the confined region of passage 13 between the rear of projectile 12 and cathode 16. Because of the pressure differential between the front and rear faces of projectile 12, the projectile rapidly accelerates toward muzzle 15.

Extrusion of insulating tube 14 out of gun 11 is prevented by the construction of cathode 16 and the use of wedges 27, as described supra, in combination with the manner in which tube 14 expands radially in response to the pressure in passage 13. The pressure in passage 13 causes tube 14 to be urged radially outwardly so the outer tube wall presses securely against the inner wall of steel gun tube 18, having sufficient strength to withstand the pressure generated in passage 13.

If the invention is used in a vacuum condition, such as subsists in outer space, the voltage applied by source 34 between cathode 16 and anode 17 is sufficient to initiate the plasma discharges in passage 13 in front of and behind projectile 12. If, however, the device is used in the atmosphere, an auxillary plasma arc initiator, such as a consumable thin metal wire made, for example of aluminum, extends through a significant portion of passage 13. The envelope including material 31 could include a metal wire that extends from the rear of the projectile to electrode 16 to help initiate a plasma discharge under atmospheric conditions. A similar wire is attached to the forward tip end of projectile 12 and extends to muzzle 15. The voltage of power supply 34 is sufficient to break down air in the gap between anode 17 and the wire to consume the wires in front of and behind projectile 12 to initiate the plasma discharge. Particularly advantageous configurations wherein such wires are included in cartridges containing projectiles 12 are described infra in connection with FIGS. 7 and 8.

The plasma that is behind projectile 12 is preferably formed from a granular or liquid material 31, as described supra. The granular or liquid material 31 is vaporized, i.e., evaporated, by the discharge between electrodes 16 and 17 into the plasma arc. The granular or liquid material 31 initially fills the region between the rear of projectile 12 and cathode 16 and undergoes a phase change from a solid or liquid into a gaseous plasma arc in the central conducting region of the material. The gases in the high pressure confined space behind projectile 12 expand axially to push the projectile down passage 13 as the arc expands radially from the central region of passage 13 to ablate material from tube 14. Because ohmic heating occurs in passage 13 immediately behind projectile 12, the projectile is accelerated, to a certain extent, in a manner analogous to a propulsive charge being attached directly to the projectile and ignited as the projectile moves through a barrel. Alternatively, liquid hydrogen could be introduced through cathode 16 into the region of passage 13 between projectile 12 and cathode 16 immediately prior to switch 35 being closed to operate in the same manner. Evaporation of material 31 by the electric discharge between electrodes 16 and 17 is particularly advantageous because the thus formed gases are hot enough and therefore have sufficiently high electrical conductance to maintain the discharge current between electrodes 16 and 17 and because the projectile is initially driven by the evaporated material 31 to a fairly high velocity of several kilometers per second. If a chemical powder were ignited the resulting gas would not be hot enough to sustain the discharge between electrodes 16 and 17 and the projectile maximum velocity resulting from the chemical ignition would be about 1 kilometer per second.

As projectile 12 moves along passage 13 the plasma behind the projectile is in a larger volume, and therefore becomes less dense. As the plasma expands it becomes hotter, whereby the plasma temperature behind the projectile rises to several electron volts. The higher temperature plasma behind projectile 12 has an increasing sound speed which maintains a high pressure on the rear face of projectile 12. As the length of the portion of passage 13 between the rear of projectile 12 and cathode 16 increases, the electric resistance thereof becomes higher despite the increased temperature of the plasma gas in the region. Thereby, there is a greater amount of ohmic heating of the plasma in passage 13 behind projectile 12 than in front of the projectile. The ohmic heating occurs in response to the discharge between electrodes 16 and 17. The increased ohmic heating behind projectile 12, together with the increasing power input of supply 34, resulting from the pulse of the power supply being shaped to have a power output that increases approximately linearly with time (due to the square of the current in the pulse increasing as a function of time), causes energy to be efficiently transferred from source 34 into the plasma between projectile 12 and cathode 16. If material 31 has a high sound speed, such as a sound speed of 15 kilometers per second for a lithium hydride plasma having a temperature of 3.5 electron volts at a pressure of 4 kilobars, the velocity of projectile 12 as it leaves muzzle 15 is on the order of 10 kilometers per second. The maximum projectile velocity that can be achieved depends on parameters of the plasma arcs in front of and behind projectile 12 and on the physics of the initiation of the plasma arc.

At the end of the input power pulse from source 34 a considerable amount of internal energy resides in the high temperature plasma, particularly the plasma in passage 13 behind projectile 12. This internal energy is optimumly transferred to kinetic energy of projectile 12 by terminating the power of source 34 while projectile 12 is still in passage 13, preferably at a point about one-third of the way down the length of the passage relative to the starting point of the projectile.

After the pulse of source 34 has been terminated and while projectile 12 is in passage 13, the temperature of the plasma in passage 13 behind projectile 12 drops sufficiently so that there is reduced additional ablation and evaporation of material in the wall of tube 14 into passage 13. The ablation almost ceases at this time partly because of the strong dependence of temperature on the radiation energy flux supplied to the wall of tube 14; the radiation energy flux supplied to the wall of tube 14 is directly proportional to the surface temperature (T) of the plasma raised to the fourth power, i.e., $T^4$. The expansion of the plasma in the region behind projectile 12 due to the increased length of the region causes the projectile to be accelerated in a manner similar to the mechanism involved in accelerating a projectile in a conventional gun tube. It is possible for projectile 12 to leave muzzle 15 at a higher velocity than the sound speed of the plasma in the region of barrel 13 behind the projectile.

Because of the high temperature of the plasma in passage 13 in front of projectile 12, the anode arc plasma flows out of muzzle 15 at high sound speed ahead of projectile 12, without being pushed by the projectile so it dose not impede the forward acceleration of the projectile. In addition, the forward velocity of projectile 12 is enhanced because anode 17 is positioned so that it is completely out of passage 13 and there is no material from the anode ablated into the passage to reduce the projectile forward acceleration. Because anode 17 is completely outside of the path of projectile 12 there is no material discontinuity from insulator to conductor encountered by projectile 12 as it traverses anode 17; such a material discontinuity could cause a destructive shock in projectile 12. However, if desired, a barrel extension section could be added beyond anode 17.

Reference is now made to FIG. 2 of the drawing wherein there is illustrated a modification of the gun described in connection with FIG. 1. In the gun of FIG. 2, igniter electrode 41 extends axially through passage 13 between electrode 16 and the rear of projectile 12. Electrode 41 includes an elongated metal rod 42 that is coaxial with passage 13 and is embedded in insulating sheath 43. At the end of rod 42 adjacent the rear of projectile 12 is a metal, somewhat hemispherical tip 44 that is integral with rod 42 and has a diameter equal approximately to the outer diameter of sheath 43. Sheath 43 extends through cathode 16 to which it is secured and punctures a rear wall of the envelope for material 31 after a cartridge including the envelope and projectile has been loaded into passage 13. The punctured portion of the envelope rear wall can be thinner than the remainder of the envelope so it is easily broken by electrode when the cartridge is loaded into the gun. To enable the amount of material 31 in the embodiment of FIG. 2 to be approximately equal to the amount of material 31 in the embodiment of FIG. 1, despite the presence of electrode 41, the portions of insulating tube 14, steel gun tube 18, insulating sleeve 19 and conducting sleeve 22 behind projectile 12 are flared outwardly and the cylindrical segments thereof have radii greater than the radii of corresponding portions of the gun illustrated in FIG. 1. A slight gap subsists between tip 44 and the black face of projectile 12 prior to launching of the projectile so that an arc can be established in material 31.

The arc is established in material 31 by connecting opposite terminals of DC shaped pulse source 46 to electrode 16 and to rod 42 by way of switch 47. In response to switch 47 being closed, current flows from tip 44 through material 31 to cathode 16. The current flowing through material 31 heats the material to evaporation and ionization; if material 31 is lithium hydride, it is heated to a temperature of 15,000° K. to initiate forward movement of projectile 12 to a velocity of several kilometers per second. After material 31 has been pressurized and ionized by the current flowing through it, switch 35 is closed to establish the anode and cathode plasma arc discharges between the electrodes of power supply 34 via anode 17 through projectile 12 to cathode 16, as described supra.

By utilizing igniter electrode 41, the efficiency of the gun is increased into a range in excess of 30%. This increased efficiency occurs because projectile 12 is translated in a forward direction prior to initiation of the discharge between electrodes 16 and 17 via projectile 12, whereby there is a delay in the anode arc pressure applied to the nose of the projectile relative to the time energy is applied to the rear of the projectile.

Figure 3A:
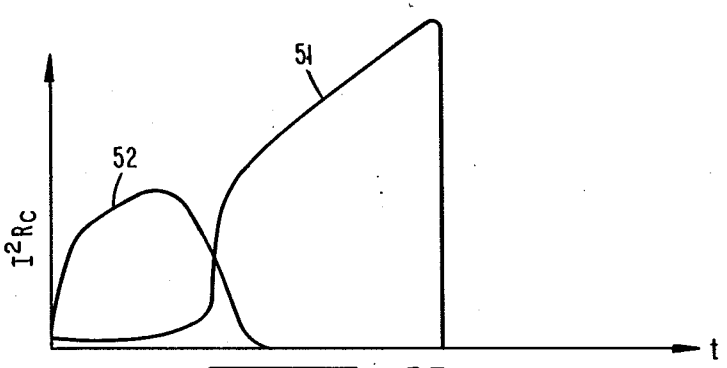

The programmed shapes of the pulses derived from sources 34 and 46 are, in the preferred embodiment, illustrated by waveforms 51 and 52, FIG. 3*a*, wherein the power outputs applied by the pulse sources to the loads therefor ($I^2R_c$) are plotted against time (t). The power pulse waveforms of FIG. 3*a* are derived from high DC voltage pulse forming networks, which can be designed utilizing well-known techniques.

Power waveforms 51 and 52 initially have zero value at t=0. Waveform 51, for the power supplied by source 34 between cathode 16 and anode 17, is initially maintained at a low value to establish the arc path ahead of the projectile. After approximately 90% of injector pulse 52 has been completed, waveform 51 increases rapidly to a value from which it increases linearly until just before the waveform is terminated, when the waveform drops suddenly and virtually instantaneously to zero. The waveform drops to zero when projectile 12 has been driven about one-third of the distance between its starting location in tube 14 and muzzle 15.

Waveform 52 rises rapidly, with a high slope from t=0. Waveform 52 then continues to increase linearly with approximately the same slope as the linear portion of waveform 51. When most of waveform 52 has been completed, the waveform drops rapidly to zero, as occurs when waveform 51 begins to increase linearly. Generally it is advisable for waveform 52 to drop to zero as waveform 51 begins to increase linearly to prevent excessive pressure in the chamber behind projectile 12.

Thus, the power represented by waveform 51 rises rapidly after projectile 12 has been driven to a fairly high speed (about 10 kilometers per second in one configuration) in response to the increasing power portions of waveform 52. Then the linear portion of waveform 51 causes the plasma arcs to drive pojectile 12 into a higher speed range so the projectile velocity is in the 15 kilometer per second range at the time the projectile leaves muzzle 15.

Figure 3B:
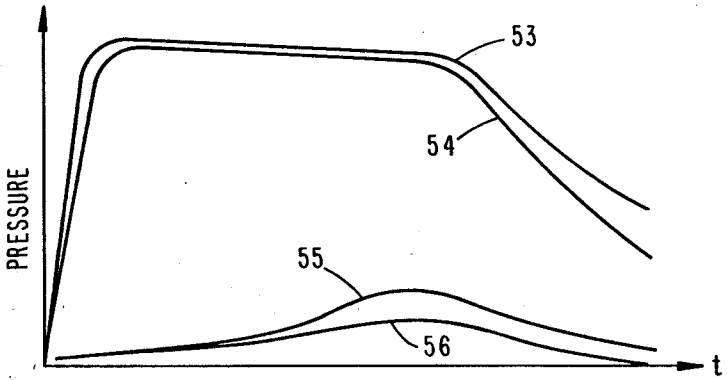

Pressure variations in passage 13 at cathode 16, at the base or rear of projectile 12, at the projectile nose and at muzzle 15 are respectively indicated as a function of time for one configuration of FIG. 2 by waveforms 53, 54, 55 and 56, FIG. 3*b*.

Waveforms 53 and 54, respectively for the pressures at cathode 16 and the base of projectile 12, indicate that the pressure in the confined region between cathode 16 and the projectile base increases suddenly and rapidly in response to the energy supplied by power supply 46 to material 31 by way of igniter electrode 41. The maximum pressure on the projectile base occurs approximately simultaneously with the peak power fed by supply 46 to igniter electrode 41. Thereafter, the pressure in the confined region between electrode 16 and the base of projectile 12 remains relatively constant, despite the increasing volume behind the base of the projectile, because of the linear increase of the power coupled by supply 34 to the plasma discharges in passage 13 in front of and behind projectile 12. The constant pressure is maintained on the base of projectile 12 until waveform 51 terminates, as occurs when projectile 12 has traversed approximately one-third to one-half of the length of passage 13. Thereafter, the pressure in the confined region decreases, as indicated by waveforms 53 and 54.

The pressure in passage or barrel 13 between the nose of projectile 12 and muzzle 15, as indicated by waveforms 55 and 56, increases gradually and reaches a peak value approximately at the time that waveform 51 reaches its maximum power. Thereafter, the pressures represented by waveforms 55 and 56 decrease gradually to values considerably less than the pressure at the base of projectile 12 when the projectile passes through muzzle 15. The pressure differential between the base and nose of projectile 12 while the projectile is in barrel 13 is sufficiently great to enable the projectile to be accelerated to velocities in the 10 to 15 kilometer per second range.

Reference is now made to FIGS. 4–6, schematic cross-sectional views of preferred embodiments of projectile 12. As stated supra, current in the discharge established between cathode 16 and anode 17 passes through projectile 12. The projectile in each of the embodiments of FIGS. 4–6 generally has a streamlined shape with a generally pointed front end 61, a cylindrical segment 62 and a flat rear face 63. Electric current flows from nose 61 to rear face 63 via each of the projectiles to sustain the plasma discharge current between electrodes 16 and 17, even though the body and majority of the volume of each of the projectiles may be fabricated of a dielectric mass 64, such as LEXAN.

In the embodiment of FIG. 4, solid metal core 65 extends longitudinally through dielectric mass 64 between nose 61 and rear face 63 which respectively include metal tip 66 and metal plate 67. Each of core 65, tip 66 and plate 67 is fabricated of a metal, with the opposite ends of the core being connected to the tip and plate to establish a high electrical conductivity path longitudinally through the projectile. Current in the discharge arc thus flows longitudinally through the projectile of FIG. 4. The exterior, exposed portions of tip 66 and plate 67 are coated with a low atomic weight electrically conducting, metallic material (not shown), such as carbon. Some of the carbon coated on tip 66 and plate 67 is ablated by the current in the discharge. Because the coatings on tip 66 and plate 67 are made of a low atomic weight electrically conducting material, the material ablated from them does not adversely affect the high velocity performance of the projectile of FIG. 4.

The projectile illustrated in FIG. 5 includes a central, longitudinally extending bore 68 that extends between nose 61 and base 63. The diameter of bore 68 is between one-fourth and one-fifth of the diameter of cylindrical body portion 62, which in turn has a length approximately equal to its diameter. The stated geometry for the projectile of FIG. 5 enables a very high pressure differential to subsist in the region of passage 13 in front of nose 61 relative to the pressure which subsists in the passage behind base 63. The relatively small diameter of bore 68 acts as a channel where there is intense ohmic heating of the plasma to produce a high density plasma. The high density plasma in the channel formed by bore 68 prevents, to a large extent, the flow of gases in passage 13 between opposite sides of the plasma, whereby a very high pressure differential is across the projectile between nose 61 and face 63.

The projectile of FIG. 4 has the advantage of completely blocking the high pressure plasma behind the projectile, to more positively prevent it from leaking forward into the anode arc region between nose 61 and anode 17. The projectile of FIG. 5 has a lower density mass; because the projectile of FIG. 5 does not have any exterior metal surfaces exposed to the arc, only low atomic weight materials are ablated from the projectile into the arcs.

In the projectile of FIG. 6, the exterior surface of the entire projectile is coated with relatively thick coating 69 of high conductivity metal, which in turn may be covered with a thin coating 70 of low atomic weight conductor, such as carbon. The remainder of the projectile of FIG. 6 could be fabricated from a dielectric hydrocarbon material, such as LEXAN.

In operation, current flows through the metallic coatings 69 and 70 of the projectile illustrated in FIG. 6. Low atomic weight material from coating 70 is ablated by the plasma discharge but does not have an adverse effect on the velocity performance of the gun, for the reasons described supra with regard to the coatings on tip 66 and plate 67, FIG. 4. The configuration of FIG. 6 is advantageous because no magnetic field subsists inside of the dielectric body of the projectile. Thereby, electronic components capable of guiding the projectile toward a target may be provided in the projectile. This is because the current flowing through passage 13 flows axially and symmetrically through the projectile outer cylindrical shell to effectively screen out fringing magnetic fields from the projectile interior. Thereby electronic components in the projectile interior are shielded from and not affected by the plasma current.

Because of the very high temperatures (e.g. 30,000°–40,000° K.) developed in the plasma discharges, tube 14, if unprotected, is rendered useless after each projectile firing and must be disposed of prior to the next firing. To this end, in certain embodiments tube 14 is consumed subsequent to each firing and the products of the tube combustion flow out of muzzle 15. The cartridge configurations of FIGS. 7 and 8 provide such a result since each includes a consumable liner that performs the function of tube 14. In the cartridge configuration of FIG. 9 that does not include such a liner, gun tube 18 is mechanically and thermally protected by a dielectric sleeve (not shown) having high compressive strength and low thermal conductivity; such a sleeve is fabricated, e.g., of woven fiber glass resin. The sleeve is protected from ablation by applying a thin coating of a hydro-carbon dielectric spray to its interior wall between adjacent projectile firings. The cartridges of FIGS. 7–9 include wedges 27, which are frictionally urged in place in the cartridges of FIGS. 7 and 8, but are bonded to the projectile in the catridge of FIG. 9 so that the bonding agent melts immediately in response to the heat produced by ignition of substance 31. (To simplify the drawing, wedges 27 are not illustrated in FIGS. 7–9).

The projectile cartridge structure of FIG. 7 includes a rigid dielectric cylindrical sleeve 71, having an outer diameter that is slightly less than the inner diameter of gun tube 18 so it easily slides into the gun tube. Sleeve 71 is fabricated primarily of a combustable, hydro-carbon that is slightly elastic in the radial direction. The inner wall of sleeve 71 and the sleeve portions closest to it which are ablated by the plasma discharge current that traverses projectile 12 include only the low atomic weight elements. At increasing radii of sleeve 71 more easily consumed dielectric compounds, such as gun powder, are admixed with the low atomic weight elements. Thus, the materials in tube 71 have a burning rate slower than the transit time of projectile 14 through barrel or passage 13 so that tube 71 is intact when the projectile escapes from muzzle 15. Thereby, while projectile is being accelerated only low atomic weight elements are ablated from the interior wall of sleeve 71 and the sleeve is virtually intact when the projectile is ejected from muzzle 15. Thereafter, the entire sleeve is vaporized and the vapor flows out of muzzle 15, leaving the interior wall of gun barrel tube 18 intact so that a new cartridge can be loaded therein.

Sleeve 71 includes axially displaced segments 72 and 73, having annular cross-sections; segments 72 and 73 are connected together by tapered region 74. Projectile 12, which may be configured in the manner illustrated in any of FIGS. 4–6, is fixedly connected to the inner wall of sleeve 71 at the rear portion of segment 72, i.e., in the vicinity of the intersection of segment 72 and region 74. Sleeve 71 is particularly adapted to be inserted into the gun of FIG. 2 when cathode 16 and igniter electrode 41 are removed. The periphery of segments 72, 73 and region 74 of the cartridge illustrated in FIG. 7 geometrically match the inner wall of gun tube 18 so that the outer wall of sleeve 71 almost abuts against tube 18 prior to switches 35 and 47 being closed.

The cartridge illustrated in FIG. 7 includes enclosed container 75 in which material 31 is located. Container 75 has rigid walls, conforming with the shape of the region behind projectile 12, and a thin wall segment in its hemispherical base; the thin wall segment is ruptured when igniter electrode 41 is pushed through it after the cartridge has been loaded into barrel 13 via a breech bore in tube 18 into which the breech block, i.e., cathode 16, is screwed or forced. Hemispherical extension 26 of cathode 16 abuts against the hemispherical base of container 75 when the cartridge of FIG. 7 is loaded into the gun of FIG. 2 and the breech block formed by cathode 16 and igniter electrode 41 is screwed or forced into the breech bore of metallic gun tube 18.

If the cartridge illustrated in FIG. 7 is used in the atmosphere, metallic, consumable wire 76 (preferably aluminum) is fixedly attached to the nose of projectile 14 and extends through the length of the cartridge to the end of tube 71 adjacent anode 17.

In operation, when switch 35 is initially closed, there is a breakdown between anode 17 and consumable electrode 76, causing a plasma discharge to form in tube 71 between projectile 12 and the open end of the tube. This plasma is formed subsequent to switch 47 being closed, as described supra in connection with FIG. 3. Tube 71 expands radially to bear against the interior wall of gun barrel 18. Hydrocarbons in tube 71 are initially ablated from the interior wall of tube 71 while projectile 13 is being accelerated. After projectile 13 has been projected out of muzzle 15, the remainder of tube 17 is completely vaporized by the high temperature in passage 13 and blows out of muzzle 15, so that no material is left on the interior wall of steel gun tube 18. Another cartridge, of the type illustrated in FIG. 7, is then loaded into the gun illustrated in FIG. 2, after the breech block including cathode 16 and injector electrode 41 have been removed from the end of steel gun tube 18. The gun is then ready to be fired again with another cartridge containing projectile 14 in place.

In the cartridge embodiment of FIG. 8, the relatively long tube 71 in the FIG. 7 construction is replaced by a compressed container 81 that is basically a folded balloon made of an elastic, dielectric hydrocarbon and consumable materials similar to those of tube 71. Balloon 81 is attached to projectile 12 (that may be configured as illustrated in any of FIGS. 4–6) and extends slightly forward of the projectile. Balloon 81 contains a chemical explosive inside of it. In addition, if the cartridge of FIG. 8 is used in the atmosphere, a folded metal, consumable, telescoping electrode 82 is located inside of balloon 81.

The cartridge of FIG. 8 also includes housing 83 that extends from the rear of projectile 12. Housing 83 has stiff walls conforming with the shape of the chamber formed by the portion of the interior wall of tube 14 behind projectile 12 and injector electrode 41. In container 83 is material 31 that is ignited by injector electrode 41 in response to switch 47 being closed.

In operation, in response to switch 47 being closed, material 31 in housing 83 is heated. Heat is transferred from housing 83 through projectile 12 to the chemical explosive in folded balloon 81. The heat so transferred to the chemical explosive in folded balloon 81 causes the explosive to be ignited, to fill the volume within balloon 81, without rupturing the balloon. The ignited gases in balloon 81 cause the balloon to expand and fill passage 13 so the balloon exterior surface contacts the interior wall of gun tube 18. As balloon 81 expands, consumable electrode 82 telescopes to a length slightly less than that of the balloon. The expanding gases evolving from material 31 begin to accelerate projectile 12 toward muzzle 15. The, switch 35 is closed and a discharge from anode 17 to electrode 82 ruptures the forward end of balloon 81. Electrode 82 is consumed to form a plasma inside of balloon 81. The plasma causes hydrogen and carbon to be ablated from the interior wall of balloon 81 to establish the plasma discharges in front of and behind projectile 12. The material of balloon 81 is pressed against the interior wall of gun tube 18 and thus forms a liner for the tube. The material in the portion of balloon 81 that is not ablated by the plasma discharge has a burning rate slower than the transit time of projectile 12 through passage 13. Balloon 81 is attached to projectile 12 by a hydrocarbon bonding agent that enables the balloon to separate from the projectile as the projectile starts to move forward in passage 13. After projectile 12 has escaped from muzzle 15 the hydrocarbon material in balloon 81 is consumed and evaporated by the high temperture gases and is ejected from the muzzle.

The cartridge of FIG. 9 merely includes projectile 12 in combination with housing 83, as described in connection with FIG. 8. If the cartridge of FIG. 9 is employed, a hydrocarbon, dielectric coating is sprayed prior to each projectile launching against the wall of the dielectric sleeve (described supra) that lines steel gun tube 18. The dielectric spray coating performs the same function as tube 14 and is applied with sufficient thickness to protect the dielectric sleeve so none of the sleeve is evaporated by the high temperature plasma and gases. The spray coating provides fuel for the plasma discharges in front of and behind projectile 12 in response to the energy supplied between electrodes 16 and 17 by supply 34 via switch 35. The deposited spray coating is evaporated by the high temperature gases remaining in passage 13 after projectile 12 has been propelled past muzzle 15. The evaporant then flows through passage 13 out of muzzle 15.

The cartridges of FIGS. 8 and 9 are relatively short and thereby are particularly adapted for rapid fire applications. While the cartridge of FIG. 7 is relatively long and thus may not be suitable for rapid fire applications, it is relatively simple, reliable, inexpensive and easy to use.

Reference is now made to FIG. 10 of the drawing, a schematic diagram of another embodiment of the invention. In the embodiment described in connection with FIGS. 1 and 2, the fluidizable material of substance 31 is initially evaporated into a plasma by discharges between cathode 16 and anode 17 and between electrode 41 and cathode 16, respectively. The thus formed plasma behind projectile 12 is then ohmically heated by the discharge between electrodes 16 and 17 that passes through the projectile into the confined region behind the projectile.

In the embodiment of FIG. 10, the plasma resulting from vaporization of substance 31 by the discharge between electrodes 41 and 16 is ohmically heated by azimuthal currents in the plasma. The azimuthal currents are generated in response to an axially directed magnetic field being applied to the plasma behind the projectile. To these ends, an inductive AC magnetic heating field is axially applied to the plasma in passage 13 behind projectile 12 by solenoidal coils 91 and 92 which are embedded in dielectric liner 93 for gun tube 18. Coils 91 and 92 are sequentially connected at predetermined times to AC power sources 94 and 95 via switches 96 and 97, controlled by timer 98, which also controls switch 47. The closure times of switches 96 and 97 relative to that of switch 47 are set in accordance with known velocity characteristics of projectile 12. Power sources 94 and 95 generate AC inductive heating currents, typically having a frequency on the order of 100 KHz.

The axial AC magnetic fields derived by coils 91 and 92 interact with the relatively low conductance of the plasma in passage 13 behind projectile 12 to establish azimuthal heating currents in the plasma. The azimuthal currents in the plasma cause ohmic heating of the plasma to provide a result similar to that described supra in connection with the ohmic heating of the plasma in the embodiment of FIG. 2 in response to the discharge between electrodes 16 and 17. The ohmic heating makes the plasma more energetic to augment the pressure of the plasma in passage 13 behind projectile 14. Switches 96 and 97 are closed in sequence immediately after projectile 12 has traversed the particular longitudinal region of passage 13 about which each solenoidal coil is wound. Thereby, the magnetic fields associated with coils 91 and 92 are applied in sequence to the plasma behind projectile 14 to provide ohmic heating thereof.

Timer 98 closes switches 47, 96 and 97 in sequence. Switches 47, 96 and 97 remain closed, once activated to the closed position, throughout the interval while projectile 12 is being accelerated through passage 13. Then, switches 47, 96 and 97 are all open circuited until the next shot.

To couple the magnetic field from coils 91 and 92 into passage 13 and to protect the coils, as well as to provide a smooth surface for projectile 12 to traverse, the coils are embedded in dielectric liner 93, preferably having an interior wall made of polyethylene so that only low atomic weight elements, such as carbon and hydrogen, are possibly ablated by the plasma into passage 13. Liner 93 includes two concentric tubes 101 and 102, with outer tube 102 abutting against a tapered wall of interior tube 101. The interior wall of tube 102 includes recesses into which the windings of coils 91 and 92 are wound. The exterior wall of tube 101 abuts against the interior wall of tube 102, in turn having an exterior wall abutting against steel gun tube 18. The magnetic field flux from coils 91 and 92 is coupled, without perturbation, into the passage of liner 93 through which projectile 12 is accelerated.

The temperature of the plasma in passage 13 in the device of FIG. 10 is sufficient to ablate some of the carbon and hydrogen atoms from the passage wall during each shot. Thereby, precautions must be taken to retain a proper close spacing between projectile 12 and the wall of passage 13 in the embodiment of FIG. 10 as well as in those of FIGS. 1 and 2. The spacing can be maintained in the embodiment of FIG. 10 by using cartridge structures and techniques similar to those described in connection with FIGS. 7–9 or inner tube 101 can be replaced after a certain number of shots.

Sequentially actuated switches 96 and 97 can be omitted if projectile 12 includes no electrically conducting parts that perturb the magnetic field derived by coils 91 and 92. If projectile 12 is an electric insulator that has no effect on the magnetic field produced by solenoids 91 and 92, the solenoidal coil arrangement can be permanently connected to suitable AC sources. In addition, a single long solenoidal coil ca replace coils 91 and 92 in such a situation. The magnetic field derived in such a configuration is inoperative until the back end of the projectile begins to pass through the region of passage 13 where the coil is located. Because no metal is in the projectile, the field is not perturbed by the projectile and is free to act on the plasma behind the projectile.

The ohmic heating provided by the apparatus illustrated in FIG. 10 provides high efficiency for guns in which passage 13 has a relatively large diameter, with relatively low amounts of power being dissipated in the solenoids. The decision as to whether to use the apparatus illustrated in FIG. 2 or in FIG. 10 depends on the specific design parameters required for launching the projectile and involves mechanical, electrical and interior ballistic issues necessary for operating pressures and gun tube length for each particular application.

While there have been described and illustrated several specific embodiments of the invention, it will be clear that variations in he details of the embodiments specifically illustrated and described may be made without departing from the true spirit and scope of the invention as defined in the appended claims.

We claim:

1. Apparatus for accelerating a projectile comprising a structure having a capillary passage with a dielectric wall containing ionizable material, first and second electrodes at spaced points along the length of the passage, the projectile being positioned in the passage, one end of the passage being closed and the other end being open so that the projectile can be projected through it, means for establishing a discharge along the length of the passage between the electrodes and through the projectile for ionizing the material from the wall in front and in back of the projectile to form a high pressure region behind the projectile to accelerate the projectile along the passage and through the open end of the passage.

2. The apparatus of claim 1 further including a mass of low atomic weight evaporable substance in the passage behind the projectile, means for evaporating the substance to establish a high pressure behind the projectile to accelerate the projectile toward the open end, the projectile being additionally accelerated by the high pressure formed behind the projectile by the ionized material.

3. The apparatus of claim 2 wherein the substance is ionizable so it is ionized by a discharge, the ionized substance and the ionizable material behind the projectile being such as to form high resistance plasma behind the projectile, the ionizable material in the passage in front of the projectile being such as to form a low resistance plasma in front of the projectile, whereby greater ohmic heating is provided behind the projectile than in front of the projectile to assist in providing greater pressure behind the projectile than in front of the projectile.

4. The apparatus of claim 3 wherein the material is such that the discharge in the passage in front of the projectile is very hot and a considerable portion of the ionized material in front of the projectile flows rapidly out of the open end of the passage ahead to the projectile without being pushed by the projectile.

5. The apparatus of claim 4 wherein the substance is such that the discharge in the passage behind the projectile is relatively cool and the plasma behind the projectile is confined in the passage behind the projectile to contribute to the high pressure behind the projectile.

6. The apparatus of claim 5 wherein the substance is fluidizable.

7. The apparatus of claim 1 wherein the projectile includes a dielectric body having a front and back and a diameter substantially equal to the diameter of the capillary passage so it can be accelerated through the passage, the projectile being constructed so that a high pressure differential can be established between the front and back thereof while it is in and is being accelerated through the passage, the projectile including a region between the front and back thereof through which current in he discharge passes.

8. The apparatus of claim 7 wherein the region includes opening means symmetrical with respect to a longitudinal center line of the projectile, the opening means having a small cross-sectional area relative to the projectile cross section and running the length of the projectile between the front and back of the projectile.

9. The apparatus of claim 8 wherein the opening means has a cross-sectional area approximately no greater than 1/16th of the projectile cross-sectional area.

10. The apparatus of claim 9 wherein the opening means has a cross-sectional area approximately no less than 1/25th of the the projectile cross-sectional area.

11. The apparatus of claim 8 wherein the opening means has a cross-sectional area approximately no less than 1/25th of the the projectile cross-sectional area.

12. The apparatus of claim 7 wherein the region includes a metal element having a high electric conductivity extending between the front and back of the projectile.

13. The apparatus of claim 12 wherein the projectile includes a coating of a further metal having a low atomic weight on the metal element at the front and back of the projectile, a portion of the coating being ablated from the element of the discharge, the coating being sufficiently thick as to prevent ablation of the metal element by the discharge.

14. The apparatus of claim 1 wherein the means for establishing the discharge includes a DC pulse source for deriving an output having a variable amplitude as a function of time so that the pressure in the passage behind the projectile remains relatively constant while the projectile is accelerated through the passage.

15. The apparatus of claim 14 wherein the amplitude of the output various so the power applied to the discharge increases in a substantially linear manner while the projectile is accelerated through the passage.

16. The apparatus of claim 14 wherein the pulse source is constructed so that the power output thereof drops substantially to zero when the projectile has traversed approximately one-third of the distance between the starting location thereof and the open end of the passage.

17. The apparatus of claim 8 wherein the opening means comprises a narrow opening in a central portion of the body.

18. The apparatus of claim 17 wherein the projectile has a length approximately equal to the diameter thereof and the opening means is a passage having a diameter approximately no greater than ¼th of the projectile diameter.

19. The apparatus of claim 18 wherein the projectile has a length approximately equal to the diameter thereof and the opening means is a passage having a diameter approximately no greater than 1/5th of the projectile diameter.

20. The apparatus of claim 17 wherein the projectile has a length approximately equal to the diameter thereof and the opening means is a passage having a diameter approximately no greater than 1/5th of the projectile diameter.

21. The apparatus of claim 12 wherein the metal element extends through the interior of the dielectric body.

22. A method of accelerating a projectile from a capillary passage having a dielectric wall with ionizable material thereon, the projectile being initially located in the passage, one end of the passage being open and the other end being closed, comprising the steps of establishing a discharge along the length of the passage between spaced points along the length of the passage and through the projectile, the discharge causing the material to be ionized in front of and behind the projectile to form a high pressure region behind the projectile to accelerate the projectile along the passage and through the open end of the passage.

23. The method of claim 22 wherein a mass of low atomic weight evaporable substance is initially in the passage behind the projectile, and evaporating the substance to establish a high pressure behind the projectile to accelerate the projectile toward the open end, the projectile being additonally accelerated by the high pressure formed behind the projectile by the ionized material.

24. The method of claim 23 wherein the substance is ionizable, applying a discharge to the substance to ionize it, the ionized substance and the ionizable material behind the projectile being such as to form high resistance plasma behind the projectile, the ionizable material in the passage in front of the projectile being such as the form a low resistance plasma in front of the projectile, whereby greater ohmic heating is provided behind the projectile than in front of the projectile to assist in providing greater pressure behind the projectile than in front of the projectile.

25. A method of accelerating a projectile from a capillary passage having: a closed end, an open end through which the projectile is launched, a dielectric wall surface of low atomic weight elements extending completely between said ends; a mass of low atomic weight ionizable and vaporizable dielectric substance in the passage behind the projectile, the method comprising the steps of ionizing and vaporizing the substance in the passage behind the projectile in response to electric energy to generate a relatively high pressure, high resistance plasma in a region of the passage behind the projectile to initiate movement of the projectile through the passage toward the open end, and after movement of the projectile has been initiated by the vaporization of the substance and while the projectile is in the passage ablating material from the wall surface past which the projectile is accelerated by ohmically heating the plasma to augment the pressure in the region behind the projectile and further accelerate the projectile along the passage and through the open end of the passage, the material ablated from the wall surface past which the projectile is accelerated being heated sufficiently by a capillary discharge in the passage along the length of the passage in back of the projectile to form additional plasma that further augments the pressure being the projectile.

26. The method of claim 25 wherein the substance is fluidizable.

27. The method of claim 26 wherein the fluidized substance is a solid.

28. The method of claim 26 further including ionizing material from the wall in front of the projectile to form a low resistance plasma in front of the projectile, whereby greater ohmic heating is provided behind the projectile than in front of the projectile to assist in providing greater pressure behind the projectile than in front of the projectile.

29. The method of claim 26 further including ionizing material from the wall in front of the projectile to form a very hot ionized material in front of the projectile so a considerable portion of the ionized material in front of the projectile flows rapidly out of the open end of the passage ahead of the projectile without being pushed by the projectile.

30. The method of claim 29 wherein the discharge in the passage behind the projectile is relatively cool so the plasma behind the projectile is confined in the passage behind the projectile to contribute to the high pressure behind the projectile.

31. Apparatus for accelerating a projectile comprising a structure having a capillary passage in which the projectile is initially positioned, one end of the capillary passage being closed and the other end being open so that the projectile can be projected though it, the passage having a dielectric wall surface of low atomic weight elements extending completely between said ends, a mass of low atomic weight ionizable and vaporizable dielectric substance in the passage behind the projectile, electric energy means for ionizing and vaporizing the substance in the passage behind the projectile to establish a high pressure, high resistance plasma in the passage behind the projectile to initiate acceleration of the projectile toward the open end, and means for ablating material from the wall surface past which the projectile is accelerated after the projectile has begun to move toward the open end by ohmically heating the plasma while the projectile is in the passage to augment the high pressure in the region behind the projectile and further accelerate the projectile along the passage and through the open end of the passage, the ablated material from the wall surface being heated sufficiently to form additional plasma that further augments the pressure behind the projectile, the means for ablating by ohmically heating including means for establishing a capillary discharge along the length of the passage past which the projectile is accelerated.

32. The apparatus of claim 31 wherein the substance is fluidizable.

33. The apparatus of claim 31 wherein the passage is a capillary, the ohmic heating means including means for establishing a discharge along the length of the passage in front and in back of the projectile.

* * * * *